US008407044B2

(12) United States Patent
Mahkonen

(10) Patent No.: US 8,407,044 B2
(45) Date of Patent: Mar. 26, 2013

(54) TELEPHONY CONTENT SIGNAL DISCRIMINATION

(75) Inventor: Arto Juhani Mahkonen, Helsinki (FI)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 115 days.

(21) Appl. No.: 13/126,894

(22) PCT Filed: Oct. 30, 2008

(86) PCT No.: PCT/EP2008/064751

§ 371 (c)(1),
(2), (4) Date: Jun. 14, 2011

(87) PCT Pub. No.: WO2010/048999

PCT Pub. Date: May 6, 2010

(65) Prior Publication Data

US 2011/0249809 A1 Oct. 13, 2011

(51) Int. Cl.
*G10L 11/06* (2006.01)
*G10L 19/00* (2006.01)

(52) U.S. Cl. ..... 704/214; 704/208; 704/212

(58) Field of Classification Search ..... 704/200, 704/208, 209, 212, 213, 214; 379/28
See application file for complete search history.

(56) References Cited

U.S. PATENT DOCUMENTS 4,812,743 A * 3/1989 Morrison ..... 324/76.31
5,694,517 A * 12/1997 Sugino et al. ..... 704/213
5,907,624 A * 5/1999 Takada ..... 381/94.2
5,999,898 A 12/1999 Richter
6,449,596 B1 * 9/2002 Ejima ..... 704/501
7,565,283 B2 * 7/2009 Fisher ..... 704/205
2005/0228647 A1 * 10/2005 Fisher ..... 704/205

FOREIGN PATENT DOCUMENTS

WO 03/063138 A1 7/2003

OTHER PUBLICATIONS

Casale, S. et al. "A DSP Implemented Speech/Voiceband Data Discriminator." Conference Record, Global Telecommunications Conference and Exhibition, 1988 (GLOBECOM '88), Nov. 28-Dec. 1, 1988.

Law, R. A. et al. "Real-Time Multi-Channel Monitoring of Communications on a T1 Span." IEEE Pacific Rim Conference on Communications, Computers and Signal Processing, May 9-10, 1991.

* cited by examiner

*Primary Examiner* — Binh Tieu
(74) *Attorney, Agent, or Firm* — Coats & Bennett, P.L.L.C.

(57) ABSTRACT

A method for discriminating a telephony content signal into a first category or a second category is described. The method comprises a filtering procedure for obtaining from the telephony content signal a band signal set comprising one or more band signals, each band signal being associated with a respective frequency band at least one of said band signals being a sub-band signal (n) associated with a sub-band of an overall frequency band of the telephony content signal. Furthermore a determination procedure is provided for determining a band signal variation value (LLn) and a band signal strength value (TLn) for each band signal (n) of said band signal set. Finally, a discrimination procedure discriminates whether the telephony content signal is of the first category or of the second category. The discrimination procedure comprises one or both of an unconditional and a conditional step for evaluating a relationship of the band signal variation value (LLn) and said band signal strength value (TLn) for said sub-band signal (n).

19 Claims, 9 Drawing Sheets

TELEPHONY CONTENT SIGNAL DISCRIMINATION

TECHNICAL FIELD

The present invention relates to communications in a network system and more particularly to a method for discriminating a telephony content signal into a first category or a second category, to a corresponding computer program product and to a signal processing device for discriminating a telephony content signal into a first category or a second category.

BACKGROUND

In the field of communications over a network, such as a telephone network, there are situations in which it is important to distinguish and discriminate the category of the traffic transmitted over the network.

For example, there are transit call cases in network nodes like media gateways (MGW) for 64 kbps PCM (Pulse Code Modulation) traffic types like speech or voice band data (VBD). A fax communication using voice band signals (for instance, in the range from 300 Hz to 3 kHz; typically the band is considered to be 4 KHz, thus leading to a range between 0 and 4 kHz) is an example of VBD, or a data communication between modems. Due to the fact that both type signals use the same band, the control plane is basically unable to tell whether the payload is speech or VBD. Sometimes it is desired that the network node does certain services also in transit call cases, which are designed to improve the perceptual quality of speech. For instance adaptive jitter buffering is such a service, which is getting more and more important, as operators are starting more and more to use packet based networks (like the Internet) for transport, in place of traditional circuit switched networks.

Services like adaptive jitter buffering may, however, prevent VBD calls from working. For instance, if buffering delay has temporarily increased within a network node due to adaptive jitter buffering, then some time later it would be good for conversational quality to make the delay small again by dropping gradually some parts of the media away—this is also sometimes called catch-up—and then further on, when a new delay peak happens, the buffer will underflow, causing insertion of some error concealment or idle pattern and so on. This would not disturb the speech so much—especially if catch-up is made during a detected silence period—however, it would destroy the integrity of VBD signals, causing retransmissions and resynchronisations of modems for instance, and eventually certain service timeouts may occur and the call will be considered finished before this is actually the case.

So some detection for these cases is desirable in network nodes like an MGW. Typical standardized or otherwise traditional) methods are to use a tone detector that is defined for a certain service in another context, like for instance for an echo canceller specified in ITU-T's G.168.

The standardized or traditional tone detectors are usually very cautious and tuned for detecting certain specific tones very reliably and accurately in order to do a reliable, irreversible and one-time decision.

This is usually also the reason why they require significant processing capacity, typically of the order of 1 MIPS (Million Instructions per Second).

Furthermore, in certain traffic cases they are too limited for covering all possible VBD or tone cases that should be detected in the given use cases.

Therefore, the above described techniques suffer from several disadvantages like inter alia not providing enough accuracy or requiring a high processing power. Said techniques may consequently be not at all suitable for certain applications.

Another known technique for discriminating between voice and voiceband data is disclosed in U.S. Pat. No. 5,999,898. Therein, the discrimination is done by calculating several parameters of the input signal. The method comprises calculating the power and the mean power of the input signal, which are then used to further calculate a power variation function of the input signal and an autocorrelation function of the input signal. The combination of said parameters is used to determine a discrimination factor providing the discriminating decision. However, this proposed method and apparatus suffer from several disadvantages as, for instance and not limited to, still requiring high processing power or not providing high accuracy. This prior art technique may further provide mis-detections and is therefore not adapted for certain applications as above discussed.

SUMMARY OF THE INVENTION

An object of the invention is to provide improvement over the known techniques for discriminating a telephony content signal between a first and a second category.

According to a first embodiment of the present invention, a method is provided for discriminating a telephony content signal into a first category and a second category. The telephony content signal is a signal adapted for carrying different categories of traffic, the categories comprising for instance speech and non-speech.

The method comprises a filtering procedure for obtaining from the telephony content signal a band signal set comprising one or more band signals. It is noted that the telephony content signal can basically be of any suitable type. According to a preferred example, it is a signal in the voice band (about 0 Hz to about 4 kHz). Each band signal of the set is associated with a respective frequency band. One of these band signals may be the input signal, e.g. having the voice band comprised between 0 Hz and 4 kHz in the case of a voice band input signal. However, at least one of said band signals is a sub-band signal associated with a sub-band of the overall frequency band of the telephony content signal. Thus, if the set only comprises one signal, then it is a sub-band signal.

The method further comprises a determination procedure for determining a band signal variation value and a band signal strength value for each band signal of said band signal set. In other words, one measure is determined that gives an indication of how strong each band signal of the set varies, and another measure is determined that gives an indication of how strong each band signal of the set is.

Furthermore, a discrimination procedure is provided for discriminating whether the telephony content signal is of the first category or of the second category. The discrimination procedure comprises one or both of an unconditional and a conditional step for evaluating a relationship of said band signal variation value and said band signal strength value (e.g. the ratio or quotient is formed and analysed) for the sub-band signal. In other words, the discrimination procedure is such that at least under a given condition a sub-band signal is assessed in order to make the discrimination decision. In the case of an unconditional step for evaluation, the relationship of said band signal variation value and said band signal strength value of the sub-band signal is necessarily considered for the discrimination. In the case of a conditional step for evaluation, the relationship of said band signal variation value and said band signal strength value of the sub-band signal is considered under a predetermined condition, e.g. that another discrimination criterion did not lead to a definite decision, such that the relationship of said band signal variation value and said band signal strength value of the sub-band signal is then evaluated as a further criterion for making a discrimination decision.

As a consequence, the method of the invention has the capacity to take into account the behaviour of a signal related to a sub-band of the overall input signal, i.e. having a smaller bandwidth than the overall input signal.

The method may be embodied as a computer program product comprising parts arranged for conducting the method.

According to a further embodiment of the invention, a signal processing device is provided for discriminating a telephony content signal into a first category or a second category.

The signal processing device comprises a filter for obtaining from the telephony content signal a band signal set comprising one or more band signals. Each band signal is associated with a respective frequency band, at least one of said band signals being a sub-band signal associated with a sub-band of the overall frequency band of the telephony content signal.

The signal processing device further comprises a determinator for determining a band signal variation value and a band signal strength value for each band signal of said band signal set.

The signal processing device further comprises a discriminator for discriminating whether the telephony content signal is of the first category or of the second category. The discriminator is suitable for evaluating a relationship of said band signal variation value and said band signal strength value for each band signal of said band signal set.

Further advantageous embodiments of the invention are defined in the dependent claims.

Furthermore, the present invention is also based on the finding and insight of the inventor that performing the discrimination on at least a sub-band of the signal, rather than only on the input signal, provides a much more accurate discrimination between different categories of the input signal. Moreover, said more accurate discrimination can be achieved while reducing the processing power required when compared to some known techniques, like those based on tone detection for instance.

The solution provided by the present invention further provides higher accuracy under different types of input signals, thus making the invention more versatile and applicable to a wide variety of applications.

The present invention obviates at least some of the disadvantages of the prior art, as for instance above explained, and provides an improved method, device and computer program for discriminating the category of a telephony signal.

DETAILED DESCRIPTION

In the following, preferred embodiments of the invention will be described with reference to the figures. It is noted that the following description contains examples that serve to better understand the claimed concepts, but should not be construed as limiting the claimed invention.

Figure 1:
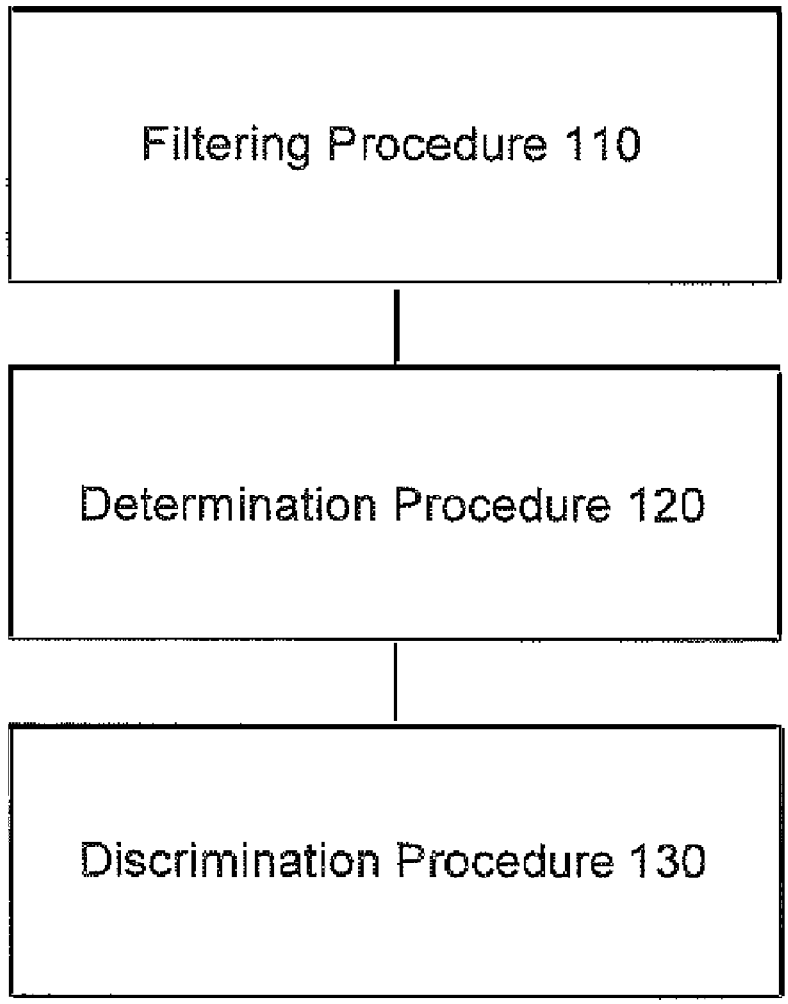
FIG. 1 is a schematic flow chart showing the procedures comprised in a method according to an embodiment of the present invention.

The schematic flow chart of FIG. 1 shows the procedures executed by a method according to an embodiment of the present invention for discriminating a telephony content signal into a first category or a second category. It is noted that more than two categories may be present, wherein the method discriminates among two of said categories or among all of said categories.

The telephony content signal is a signal adapted for carrying different signal categories or signal types. For example the first category of telephony content signal can be speech and the second category can be non-speech. The category of speech may comprise traffic related to voice calls, coded for instance according to PCM. It is noted that, however, other different types of coding can be used, as for instance modification of the PCM like Differential PCM, Adaptive PCM or other types of coding like FR, AMR and others that the skilled person would readily recognize as suitable for the desired application. It should be noted that speech coded according to certain types of coding like A-/μ-Law PCM, GSM FR, GSM EFR or AMR, should be decoded to the linear sample domain before being processed according to the present invention. The decoding to the linear sample domain may be performed as a pre-processing step. The decoded linear samples may be packetized in blocks of e.g. 40 or 160 samples per time). The category of non-speech may comprise traffic related for instance to transmission of facsimile, to transmission of data by means of a modem or transmission or other types of messages or signals like CTM (Cellular Text Telephone Modem) signals. In the case of a voice band input signal, the non-speech category may be seen as comprising voice band data (VBD), since it comprises data carried over the same frequency band as used for voice calls.

Alternatively, the categories can also be selected in such a way that one of the categories is data, and another non-data. Further alternatives consist in that the categories can be selected in such a way that one (or some) of the categories is behaving stationary in one (or some) of the sub-bands and one (or some) of the categories is non stationary in the respective sub-bands. By stationary in this context is meant that the band signal variation (LLn) is clearly smaller compared to the band signal strength (TLn) than for the non-stationary category.

The filtering procedure (110) obtains from the telephony content signal a band signal set comprising one or more band signals, wherein each band signal is associated with a certain frequency band. In other words, the filtering procedure produces from the telephony content signal one or more band signals each having a respective frequency band which can be narrower than or comprised within the frequency band of the telephony content signal. Obtaining the band signal set may comprise an operation of filtering the telephony content signal in order to produce a given number of band-signals and including only a predetermined number of said given number of sub-band signals in the band signal set. In other words, if the filtering itself produces a number of $N_{BS}$ band signals, the band signal set obtained through the filtering procedure may comprise just only one of said $N_{BS}$ band signals or a given number $N_{set}$ of said band signals, wherein $N_{set}$ is smaller than or equal to $N_{BS}$. Moreover, the band signal set may also comprise the telephony content signal itself, i.e. the unfiltered signal.

The filtering can be performed in any suitable or desirable way known to the skilled person in the art. For instance, as it will be explained in further embodiments of the invention, filtering based on a decimation technique can be used. However, the invention is not limited to the decimation technique but can be also put into practice by implementing different filtering techniques, as long as these techniques produce at least one sub-band signal having a predetermined frequency band smaller than that of the input telephony content signal.

At least one of the band signals comprised in the band signal set is a sub-band signal associated with a sub-band of an overall frequency band of the telephony content signal. In other words, at least one band signal of the band signal set is a sub-band signal obtained through filtering and, consequently, is characterized by having a frequency band falling within the frequency band of the telephony content signal.

As mentioned above, the telephony content signal can be in one example a PCM coded signal, also referred to as a PCM voice band signal. However, the invention is not limited to this example of coding technique, but can also be applied, as explained above, to signals coded according to other techniques.

The method for discriminating the telephony content signal further comprises a determination procedure (120), also illustrated in FIG. 1, for determining a band signal variation value and a band signal strength value for each band signal of said band signal set. The band signal variation value is a value indicating the level of variation of the band signal. This value can be calculated in several ways.

For example, the band signal strength value can be determined as the average signal power over a given time period, and the band signal variation value can be determined as a variance with respect to that average signal power over the given time period.

For the purpose of explanation, a band signal set has $N_{Set}$ members, each generically designated n, where $n=\{1, \ldots, N_{set}\}$ and $N_{set}>0$. The signal processing of each band signal n will generally comprise determining corresponding band signal levels $b_n$, e.g. values $b_n(i)$ as output by a sampling circuit at points i.

In order to simplify the calculation requirements compared with calculation of average signal power and power variance in known ways, it is possible for instance to sum differences between (preferably consecutive) values of samples of the band signal as a basis for determining a variation value of a given band signal n. Preferably said differences should be calculated on positive measures of values of samples of the band signal, for instance by calculating the absolute value or the square value of the values of the samples of the band signal. Differences calculated between non positive measures may however be applicable in certain specific situations, when for instance the values of samples are already positive or almost always positive. These samples can be identical to the level values $b_n(i)$, or they may result from a processing of the level values, e.g. over desired time intervals. In general, a sample value for a band signal n may be designated as $bl_n$ and can preferably be defined as $$bl_n = \sum_{i=0}^{N_n-1} |b_n(i)|$$

where $N_n$ represents an interval size over which the level values are processed. $N_n$ can basically be chosen in any suitable or desirable way, e.g. equal to 1, in which case the sample value is equal to a single level value. $N_n$ can also be chosen to correspond to a desired time interval $\Delta x$, e.g. 50 ms. Depending on the number of sampling points available after filtering, $N_n$ may be different for each n. It is noted that it is preferable to determined $bl_n$ by summing over absolute values, but this is not a necessity. Calculation of absolute values can also be dispensed with if the signal level values $b_n(i)$ are all positive.

the signal levels $b_n(i)$ need not necessarily be in a sampled form, as in fact also operation on an analog signal (not digital sampling) is possible by using suitable circuitry for calculating the band signal value (e.g. suitable circuitry for detecting a level of the signal at a given time or a circuit for integrating the signal over a given period) or band signal variation value (e.g. suitable circuit for evaluating the difference of values at different time instants).

The indicated sum may also be taken over differences between samples of non consecutive points, e.g. as differences between values representative of signal levels at arbitrary time instants.

In general, the determination of a variation measure may comprise calculating a property that can be called the "line length" of the band signal, where the "line length" represents the length of the line resulting from a plot in the time domain of the band signal. One way to calculate the line length of the signal is to take into account the difference between the values of two signal samples and the time distance separating the two signal samples, e.g. by summing the square value of said values and calculating the square root of the obtained sum. When the time difference between signal samples is known, constant or not influencing the final result, the line length can be approximated by the sum of the absolute values of the differences of values of signal samples at consecutive time instants.

As mentioned, the determination procedure may comprise determining band samples, where a band sample is indicative of the level of the signal. A band sample can comprise a single value representing the level of the signal, for instance a sampled value of the amplitude of the signal (however, also non-sampled values are suitable as illustrated above). A band sample can also comprise the sum of a given number of signal levels, for instance a band sample can comprise the sum of consecutive samples or the sum of samples in a given set (however, also non sampled values are suitable as illustrated above). Determining the band signal variation value may comprise summing differences of the band samples over a predetermined range. In other words, determining the signal variation value may comprise determining several band samples as indicated above (e.g. each band sample representative of a single value of the signal level or of a sum of a plurality of signal levels of the signal), calculating differences between the determined band samples (e.g. the difference between any of the two determined band samples; or a plurality of differences between arbitrary couples of band samples chosen among the determined band samples) and summing the calculated differences. The predetermined range may comprise a predetermined period or time window Δx, in which each band sample is determined. For instance, a band sample may be determined as a value representative of the signal level at each period Δx (e.g. 50 ms). In another example, the band sample may be determined as the sum of values indicative of the signal value, wherein the values are those occurring within a given time window.

As described, the differences of the band samples can be differences of consecutive band samples. In other words, the band signal variation value can be calculated as the difference between two consecutive single values representing signal levels at two time instants separated by a given period (e.g. when a band sample represents a single signal level) or as the difference between two sums of a plurality of values each representing level of the signal, each of the plurality of values detected or occurring in a given period or time window, wherein the two sums refer in an example to two consecutive periods or time windows.

Thus, the band variation value for band signal n, referred to as LLn' (LL stands for line length), can be calculated according to the following:

A plurality of time windows or periods 1, . . . , −k−1, k, . . . , $N_s$ is chosen and the band variation value can be calculated as the sum of all the absolute values of the differences between consecutive band samples according to the following:

$$LL'_n = \sum_{k=0}^{N_s} |bl_n(k) - bl_n(k-1)|$$

where $bl_n(k)$ and $bl_n(k-1)$ are band samples in or at the corresponding periods k and k−1. This is only an example, and the summation result may e.g. be averaged over the periods or time windows considered, as in the following:

$$LL'_n = \sum_{k=0}^{N_s} |bl_n(k) - bl_n(k-1)| / N_s$$

wherein $N_s$ represents the total number of periods or time windows considered. Obviously, other formulas for deriving a variation measure based on sample differences are envisionable.

The examples illustrated above are easy to calculate and require a very low processing power. When the calculation is not based on single values but on a significant number of signal levels occurring in a given period or time window Δx, the result is more reliable since it is not biased by instantaneous or sporadic variations as caused e.g. by noise, transmission or coding errors.

Preferably, determining the band variation value comprises summing the absolute values of the indicated differences. The advantage provided consists in that the determination is more accurate since it is not influenced by negative values that may occur in the sampling.

Similar considerations done with respect to the band variation value also apply to the calculation of the band signal strength value, which may also be calculated starting from band samples as indicated above. Therefore, for instance, the signal strength value can be calculated as a single signal level chosen as representing the strength of the signal, or as the sum of signal levels occurring at predetermined periods of time or as the sum of signal levels occurring in a given period or time window. The period or time window can advantageously be one in which the band variation value is also calculated. The sum of signal levels or band samples may obviously comprise the sum of corresponding absolute values. The different possible implementations carry the same advantages in terms of accuracy and reliability of the result as illustrated with respect of the calculation of the band variation value.

Thus, by making the same considerations as made above with respect to the band variation value, the signal strength value for a band signal n, referred to as $TL_n'$ (TL stands for total level), can be calculated in a variety of ways, as illustrated according to any of the following examples or to variations thereof as long as they provide an indication of the strength of the band signal:

$$TL_n' = bl_n(k)$$

wherein $bl_n(k)$ is a single sample value in period or time window k Preferably, $TL_n'$ is determined according to:

$$TL'_n = \sum_{k=0}^{N_s} |bl_n(k)|$$

where a plurality of periods are considered; or according to:

$$TL'_n = \sum_{k=0}^{N_s} |bl_n(k)| / N_s$$

where the sum over a plurality of periods is averaged over the number of periods. Obviously, other formulas for deriving a signal strength measure based on summing sample values are envisionable.

In the determination procedure of the invention, it is sufficient to calculate one band signal variation value and one band signal strength value for each band signal, and to then conduct a discrimination procedure. Preferably, the determination procedure is performed for successive decision points, referred to as s in the following, where for each decision point s a preliminary band signal variation value (LLn') and a preliminary band signal strength value (TLn') is determined for each band signal of the band signal set. The decision point can be for example a time instant in which the determination procedure is executed or in which the discrimination procedure is executed. For instance, when making a decision at a given time instant, preliminary values are first calculated for the band signal variation value and for the band signal strength value in one of the ways explained above. Then, depending on the preliminary values, for instance in relation to the corresponding values calculated at a previous decision point or in relation to thresholds, it is decided whether to take the preliminary values as the values which are to be used at the given decision point for the purpose of the subsequent discrimination step (e.g. final values for the given decision point) or whether to modify the preliminary values according to predetermined parameters in order to obtain the values for discrimination at the given decision point, or whether to maintain values which were calculated at a previous decision point and e.g. discarding the momentary preliminary values.

Thus, the determination procedure may comprise a modification procedure which determines for each band:

- the band signal variation value (LLn) for a given decision point (s) in dependence on the preliminary band signal variation value (LLn') and the band signal variation value associated with a previous decision point (s−1), and/or
- the band signal strength value (TLn) in dependence on the preliminary band signal strength value (TLn') and a band signal strength value associated with a previous decision point (s−1).

The modification or correction and the use of preliminary values for determining the values of a given decision point, as explained above, provide improved accuracy and resiliency to mis-discriminations.

In one example, the band signal variation value (LLn) at a given decision point s can be calculated according to the following:

$$\text{if } (LL_n' < LL_n(s-1))\, LL_n(s) = LL_n'$$

$$\text{else } LL_n(s) = (1-\alpha_1) * LL_n(s-1) + \alpha_1 * LL_n'$$

where LLn' represents the preliminary value (n stands for a band of the band signal, i.e. a sub-band of the telephony content signal or the unfiltered telephony content signal) and LLn(s) the value determined at the given decision point and that is used at the given decision point for discriminating the telephony content signal. In other words and by reference to this example, the preliminary value LLn' of the band signal variation value is calculated, for instance following one of the ways described above. If it is found that the preliminary value of the band signal variation value at a point s is lower than the corresponding value at a previous decision point, preferably the immediately preceding decision point s−1, then it is determined that the value of the band signal variation value LLn at the given decision point s may be set equal to the preliminary value LLn'. Different conditions, comprising complex function, other than the one indicated above, can obviously be indicated as long as they provide an indication of how the signal variation value varies over different decision points. In the other case, i.e. when the preliminary value is larger than or equal to the corresponding value at a previous decision point, then the value of the band signal variation value LLn at the given decision point is determined as a function of the preliminary value LLn', in some implementations corrected by suitable predetermined coefficients, and/or of the corresponding value at a previous decision point, is some implementations corrected by suitable predetermined coefficients. The coefficients can be determined once, for instance through configuration or optimizing procedures, but may also be adaptive coefficients, i.e. dynamically changing according to situations.

Following similar considerations, the band signal strength value TLn(s) at a given decision point s (where n stands for a band of the band signal, i.e. a sub-band of the telephony content signal or the unfiltered telephony content signal) may for example be calculated according to the following:

$$\text{if } (TL_n' > TL_n(s-1))\, TL_n(s) = TL_n'$$

$$\text{else } TL_n(s) = (1=\alpha_2) * TL_n(s-1) + \alpha_2 * TL_n'$$

In other words, a preliminary value is calculated in one of the examples described above. Then, the value used at the given decision point is determined as the preliminary value if a given condition is verified, e.g. when the preliminary value is larger than the corresponding value at a previous decision point. Other conditions comprising functions may of course be used, as long as they provide an indication of how the signal strength variation varies between decision points. When it is judged that the mentioned condition is not verified, then the value at the given decision point is calculated as a function of the corresponding preliminary value and/or the value at a previous decision point. The function may comprise appropriate predetermined or adaptive parameters, similar to the parameters mentioned for the calculation of the band signal variation value.

In the above examples, the variation of the band signal variation value and/or the variation of the band signal strength value between different decision points s are estimated before deciding which values to actually use at the given decision point for the subsequent discrimination. This is an example of the more general idea of providing a kind of asymmetric low pass filtering of the band signal variation value and band signal strength value. According to the above examples, the band signal variation value at a given decision point is taken as the preliminary value when it decreases compared to the value at a previous decision point; otherwise, i.e. when the band signal variation value increases or is changed compared to a previous value, its value is damped. Similarly, the band signal strength value may be damped when its value decreases from a preceding point. One consequence of the above implementation is that the decrease between two decision points of the ratio between the band signal strength value and the band signal variation value (TLn/LLn) is damped when the band signal variation value increases and/or when the band signal strength value decreases. As it will be apparent also in conjunction with what will be explained in the following, the ratio TLn/LLn may be used in one example to discriminate the telephony content signal. The above mentioned damping provides that changes from high values of TLn/LLn to low values of TLn/LLn is damped, i.e. a change from high values to low values of said ratio is "delayed" or smoothed. As a consequence, as it will be apparent also from the following discussion, in a speech/non-speech discriminator false detections of non-speech as speech are avoided. Such false detections can cause problems in certain applications, therefore the proposed examples provide higher reliability by avoiding undesired false discriminations. By appropriately changing the conditions to verify and the parameters, different false detections may be avoided, i.e. false discriminations of speech as non speech may be avoided by inverting the conditions to test in the above examples and adapting the coefficients as necessary.

In the above example where the determination procedure is performed for successive decision points, the band signal variation value and the band signal strength value can be calculated according to any of the examples previously mentioned. This allows determining parameters which are more accurate since the determination is made by taking into account different decision points and results in a more accurate and reliable discrimination of the telephony content signal, reducing the occurrence of mis-discriminations.

As discussed, the modification procedure described above can advantageously be asymmetric for damping increases in said band signal variation value (LLn) and/or decreases in said band signal strength value (TLn). The corresponding advantages consist in preventing false-discriminations.

Such a damping effect can be achieved by arranging the modification procedure for setting the band signal variation value (LLn) for the given decision point (s) such that:

$$LL_n(s)=(1-\alpha_1)\times LL_n(s-1)+\alpha_1\times LL_n'$$

if LLn'>LLn(s−1), where LLn(s) represents the band signal variation value for the given decision point, LLn(s−1) represents the band signal variation value for the previous decision point, $\alpha 1$ represents a constant with $0 \leqq \alpha 1 \leqq 1$, and LLn' represents the preliminary band signal variation value. In addition or as alternative to the above condition, the modification procedure may be further arranged for setting the band signal strength value (TLn) for the given decision point (s) such that $$TL_n(s)=(1-\alpha_2)\times TL_n(s-1)+\alpha_2\times TL_n'$$

if TLn'<TLn(s−1), where TLn(s) represents the band signal strength value for the given decision point, TLn(s−1) represents the band signal strength value for the previous decision point, $\alpha 2$ represents a constant with $0 \leqq \alpha 2 \leqq 1$, and TLn' represents the preliminary band signal strength value. The above conditions provide the advantage of avoiding undesired mis-discriminations, thus increasing the reliability and accuracy of the method.

As shown in FIG. 1, after the determination procedure, the method then advances to the discrimination procedure (130) for discriminating whether the telephony content signal is of the first category or the second category. The discrimination procedure specifically comprises one or both of an unconditional step and a conditional step for evaluating a relationship of the band signal variation value (LLn) and the band signal strength value (TLn) for the at least one sub-band signal (n) in the band signal set. Preferably, appropriate unconditional and/or conditional steps are provided for every sub-band signal in the band signal set.

The step of evaluation can be implemented in different ways as is evident to the skilled person in the art and as described in the following part of the present specification.

The unconditional step of evaluating the relationship is a step which is always executed by the discrimination procedure. In other words, the discrimination procedure is configured such that it evaluates the mentioned relationship regardless of any kind of conditions. An example of this is an implementation of the method in which the band signal set only has one member, i.e. a sub-band signal, and the discrimination procedure is such that every time that it is invoked, it necessarily evaluates the relationship of the variation value LL and the strength value TL for that sub-band. Another example would be if the band set comprises several sub-band signals and the discrimination procedure is such that the relationship of LLn and TLn is evaluated for each of the sub-bands for making the discrimination decision.

A conditional step of evaluating the relationship is on the other hand a step which is performed only when a given condition is fulfilled. This can be the case, for instance, when a predetermined event occurs like the detection of a silence period or the detection of a predetermined timing condition. In other examples, the conditional step can be performed upon detection that another discriminating criterion is not judged to successfully have performed the discrimination of the telephony content signal. In a further example, the conditional step may be performed upon detecting the necessity to switch from a discriminating mode of first accuracy to a discriminating mode of a second accuracy, the second accuracy being higher than the first. Moreover, the conditional step may be activated for instance when the discrimination performed on the unfiltered signal is determined as not being accurate enough or as not adapted for a specific application. In other words, the discrimination procedure (130) can be configured such that evaluating the relationship on the band signal variation value and the band signal strength value of the sub-band signal may be activated only under certain conditions, non limiting examples of which have been explained above.

The unconditional and conditional steps provide the advantage of having a more flexible discriminating method which can be easily adapted to different situations and applications while balancing accuracy and processing resources. Namely, the discrimination procedure is in any case capable of taking into account the LLn/TLn relationship for one or more sub-bands, at least under specified conditions, such that the discrimination is capable of higher precision and more accurate discrimination in comparison with a method that relies on the complete input signal alone.

Nonetheless, the present invention specifically envisions also making use of the unfiltered full-band input signal, if this is desired, in addition to the capability of using one or more sub-band signals for the discrimination. This input signal may be referred to as n=0 in the band signal set. To give an example, the discrimination procedure may comprise an unconditional step for evaluating a relationship of the band signal variation value (LL0) and the band signal strength value (TL0) for the unfiltered telephony content signal (0). In other words, the method may further evaluate also the unfiltered telephony content signal regardless of any kind of conditions, e.g. the method may also always evaluate the unfiltered signal. The discrimination procedure may then comprise a conditional step for evaluating a relationship of the band signal variation value (LLn) and the band signal strength value (TLn) for one or more sub-band signals (n), depending on whether the unconditional step is judged to provide a result. In other words, the discrimination procedure may be configured to perform the conditional step for evaluating the relationship for the sub-band signal when it is determined that the unconditional step for evaluating the relationship for the unfiltered signal is not suitable for a given application or that it is not able to provide a discrimination or that it is not accurate enough or in similar situations as would be apparent to the skilled person. Said configuration makes the method more versatile and suitable for implementation in a variety of applications while increasing its reliability and accuracy.

For the case where the categories are speech and non-speech, the discrimination into the categories means discriminating a speech-state or a non-speech-state. As will be explained in more detail further on, a high degree of variation in a signal can be associated with speech, whereas a low variation can be associated with non-speech. Based on this fact, the discrimination procedure may for example be such that a non-speech state is discriminated if for at least one of the band signals (n) of the set it is determined that the band signal strength (TLn) and the band signal variation value (LLn) are such that a ratio of the band signal strength value (TLn) and the band signal variation value (LLn) exceeds a predetermined first threshold (HIGH_LIMIT). The discrimination procedure may comprise actually calculating the indicated ratio and comparing it with a threshold, but alternative implementations are also possible, e.g. comparing the band signal variation value and the signal strength value with one another.

The above concept may be implemented in a variety of ways. For example, the positive discrimination of a non-speech state may be made whenever the ratio between the band signal strength value (TLn) and the band signal variation value (LLn) exceeds a threshold for any one of the sub-band signals or for the unfiltered signal. In other implementations, the discrimination of the non speech state may be made when the ratio exceeds the threshold for at least two or more of the bands n among the sub-bands and the unfiltered signal. In one example, if a band signal set is chosen comprising one or more sub-bands and/or the unfiltered signal, the non speech state may be discriminated when the ratio exceeds the threshold for all of the bands in the band signal set. Furthermore, different thresholds can be used in association with different signals n of the band signal set. The introduction of the first threshold avoids undesired false discriminations and thus increases the accuracy of the method of the invention.

The discrimination procedure may further foresee that a speech-state is positively discriminated if for k of the band signals (n) it is determined that the band signal strength (TLn) and the band signal variation value (LLn) are such that a ratio of the band signal strength (TLn) and the band signal variation value (LLn) falls below a predetermined second threshold (LOW_LIMIT), said set comprising N band signals, k and N being integers, and $k \leqq N$. The set may comprise one or more sub-band signals and/or the unfiltered signal. The second threshold LOW_LIMIT may be identical to the previously discussed first threshold HIGH_LIMIT, but preferably LOW_LIMIT is smaller than HIGH_LIMIT. For example, the first threshold may be 20 and the second 10. The introduction of the second threshold also avoids undesired false discriminations and thus increases the accuracy of the method of the invention.

Figure 10:
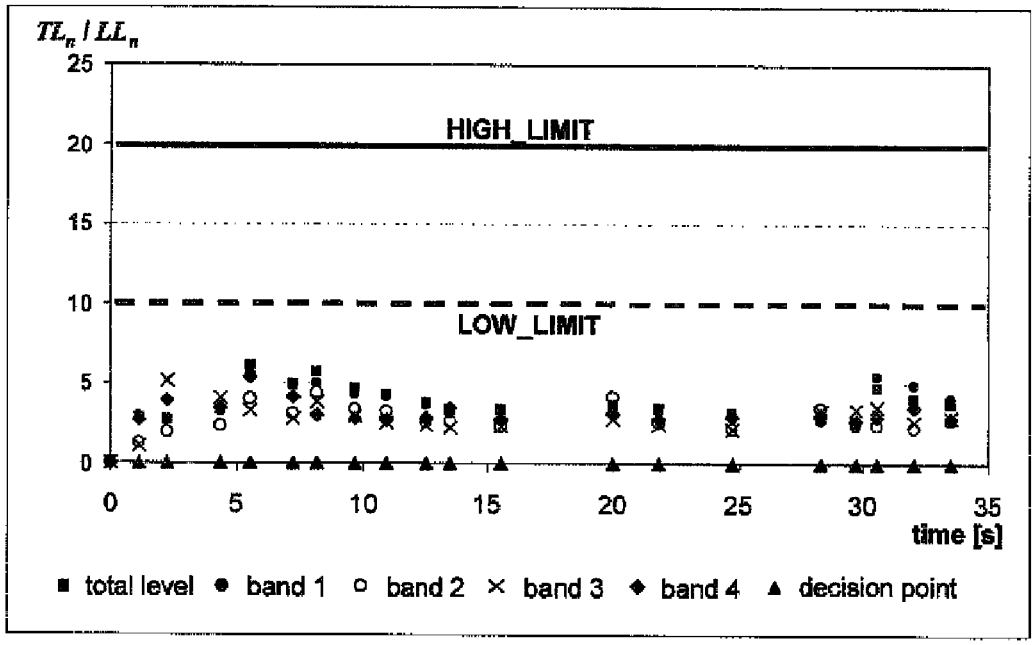
FIG. 10 illustrates the ratios between band signal strength values and band signal variation values (TLn(s)/LLn(s) ratios) for a speech recording according to an example; the graph refers in the example at a time instant [s] representing a decision point.
Figure 11:
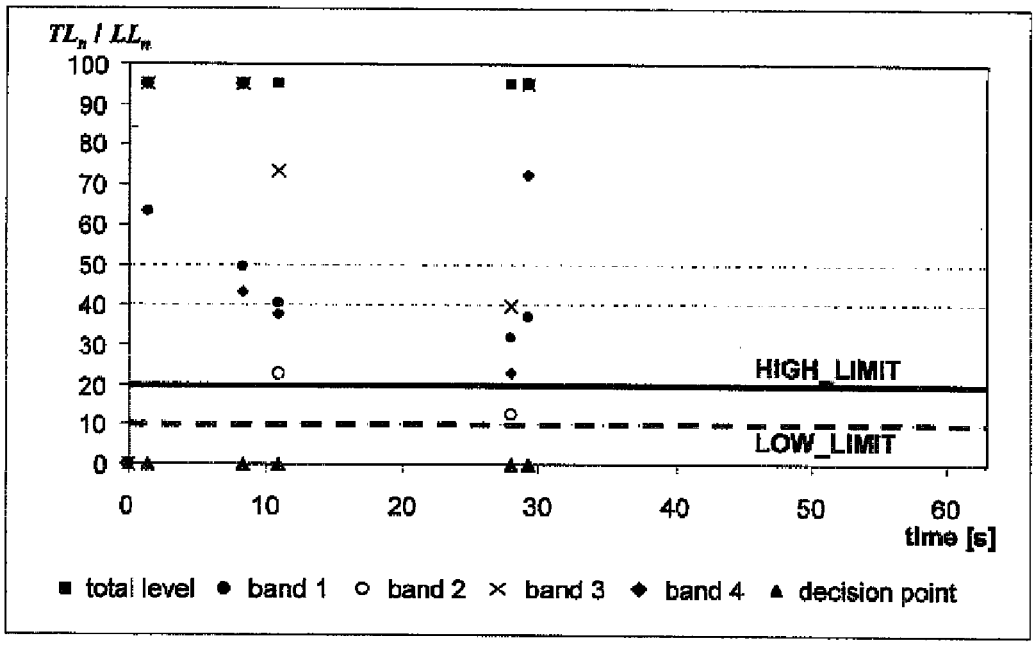
FIG. 11 illustrates the ratios between band signal strength values and band signal variation values (TLn(s)/LLn(s) ratios) for a non speech recording like a VBD recording; the graph refers in the example at a time instant [s] representing a decision point.

FIGS. 10 and 11, which will be described further on, show the behaviour of speech and non-speech signals in the PCM domain and how the thresholds can be set by the skilled person in order to avoid undesired mis-discriminations.

As already indicated, the invention can be implemented in such a way that only one set of values for one point in time in evaluated. Preferably, however, the discrimination procedure is performed for successive decision points (s). The procedure may comprise a speech state detection part and a non-speech state detection part, i.e. one set of steps applying criteria for deciding whether the signal under examination is in a speech-state, and another set of steps applying criteria for deciding whether the signal under examination is in a non-speech state. The two detection parts may be arranged such that the invocation of one is dependent on the other not having provided a positive decision. If neither the speech state detection part nor the non-speech state detection part result in a discrimination result, a discrimination state from a previous decision point may be retained, preferably from the immediately preceding decision point (s−1).

It is noted that the method of the above embodiment and the therein described procedures may be implemented through hardware, software or any combination of hardware and software as the skilled reader may deem appropriate depending on the circumstances. Moreover, a computer program product may be provided comprising program parts arranged for conducting any part or procedure of any of the previously described methods according to the invention when the computer program is executed on a programmable processor.

Moreover, a computer readable medium may be provided in which the program is embodied. The computer readable medium may be tangible, such as a disk or other data carrier or may be constituted by signals suitable for electronic, optic or any other type of transmission. A computer program product may comprise the computer readable medium.

Figure 2:
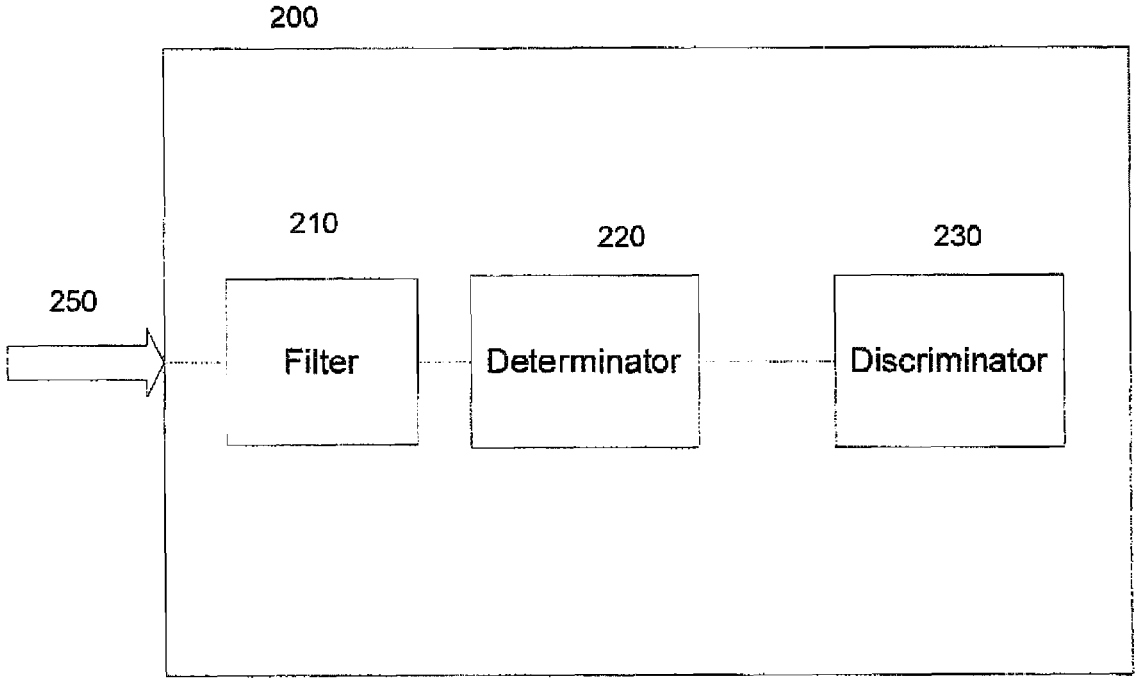
FIG. 2 is a block functional diagram of a signal processing device according to another embodiment of the present invention.

The present invention can also be embodied as a signal processing device arranged for implementing one or more of the above described methods. Reference will now be made to FIG. 2 showing an example of a signal processing device (200) for discriminating a telephony content signal into a first category or a second category, wherein the telephony content signal and the categories thereof are as described above with reference to the method embodiments.

The signal processing device (200) comprises a filter (210) for obtaining from the telephony content signal (250) a band signal set comprising one or more band signals, where each band signal band is associated with a respective frequency band. The filter (210) may comprise also a bank of filters appropriately arranged and, in one embodiment as explained in the following, can be a bank of filters for obtaining a decimation of the telephony content signal. However, other filter blocks, filtering components or filter configurations may be employed for obtaining at least a sub-band signal having a frequency band falling within the frequency band of the telephony content signal. The filter (210) may further be implemented by hardware, by software or any suitable combination thereof.

For the telephony content signal, the band signals and the sub-band signals the same considerations made above still apply.

At least one of the band signals of the band signal set is a sub-band signal (n) associated with a sub-band of an overall frequency band of the telephony content signal, as obtained for instance by means of the filter (210).

The signal processing device (200) further comprises a determinator (220) for determining a band signal variation value (LLn) and a band signal strength value (TLn) for each band signal (n) of the band signal set. The determinator is arranged to perform the determination procedure in any of the above described ways.

The signal processing device (200) further comprises a discriminator (230) for discriminating whether the telephony content signal is of the first category or of the second category. The discriminator (230) is suitable for evaluating a relationship of said band signal variation value (LLn) and said band signal strength value (TLn) for each band signal (n) of the band signal set. In other words, the signal processing device (200) is arranged such that it can evaluate the mentioned relationship, according to certain conditions detected by the device or communicated to the device or according to a predetermined configuration of the device itself. For instance, the discriminator can be configured to perform the evaluation when a predetermined timing is detected, when another discriminating method is determined as not accurate enough or as not suitable for the application. In one example, the discriminating is configured to evaluate at least a sub-band signal when a method based on discrimination of the unfiltered signal is determined as not accurate or as not able to provide a decision or a reliable decision. The advantage of such configuration lies in a more flexible device which can operate under several conditions and which can be conveniently configured according to the application or circumstances.

The signal processing device (200), and/or the filter (210), and/or the determinator (220) and/or the discriminator (230) can be further configured to carry out functions or procedures as described with reference to methods embodying the invention. For example, these elements can be implemented by software in a programmable processor, i.e. the processor can act as a filter, a determinator and as a discriminator.

Now a detailed example for speech/non-speech discrimination in the PCM domain will be presented, showing how a number of the above described examples of the filtering procedure, the determination procedure and the discrimination procedure can advantageously be combined. However, this is only an example and the general invention is neither limited to the PCM domain nor to speech discrimination, as it can also be applied to other coding schemes and for other categorizations of telephony content signals.

One aspect of this speech/non-speech discriminator is that it inverts the detection problem and its solution compared to certain prior art techniques discussed previously. Namley, it does not try to identify certain tones accurately, but instead tries to detect when the media is speech and when not. This is a generic solution valid for all VBD and tone cases.

According to a preferred example, invocation of the discrimination method or triggering of the signal processing device comprising the discrimination may be made dependent on detection of a silence period in the PCM signal. Silence can be detected in any known way using an appropriate PCM-domain silence detector. The decisions are based on signal level measurements, which are carried out for certain frequency sub-bands that are separated by some digital filter bank for instance. In this embodiment of the invention the filter bank may be based on state of the art all-pass sub-filter blocks, as will be discussed later. However, the skilled person will recognize that also other filtering techniques are suitable as long they can produce at least a sub-band signal having a frequency range comprised within the frequency band of the telephony content signal.

Furthermore, the total signal level is also measured. Measurements may be sampled over certain intervals (e.g. 50 ms, 20 ms or other intervals as the skilled person would recognize as appropriate depending on circumstances). The speech/non-speech discrimination of the embodiment is based on analyzing the behaviour of the sub-band level measurements. It was found that by comparing the average sub-band levels to a respective average line length of the sub-band level sample curve it is possible to discriminate speech from non-speech (i.e. VBD or tones) during active periods of the media. The reason for this is that the variances of the sub-band level measurements are clearly higher for the speech than for the tones/data signals, which means that the ratios of the average sub-band levels to the respective average line lengths are clearly higher for tones/data signals (i.e. non-speech) than for speech. The line length may e.g. represent the length of the signal when plotted in the time domain.

It was further found that the required processing capacity for this algorithm is extremely low, only of the order of 0.1 MIPS, which is about one tenth of the processing capacity required by the standardized or traditional tone detection methods. Thus, a discriminating method or a discriminator can be achieved which achieves high accuracy while requiring low processing power.

Reference will now be made to further details of an embodiment of the invention applied to a PCM domain. This embodiment provides a combination of some examples illustrated above and shows how these can be implemented together according to the present invention. However, modifications are foreseen as evident from the further examples and illustrations given in the present description and as it would be evident to the skilled person. The discriminator hereinafter referred to may be an implementation of the signal processing device discussed above. The same considerations and corresponding advantages however apply also when using coding techniques different than PCM.

Figure 3:
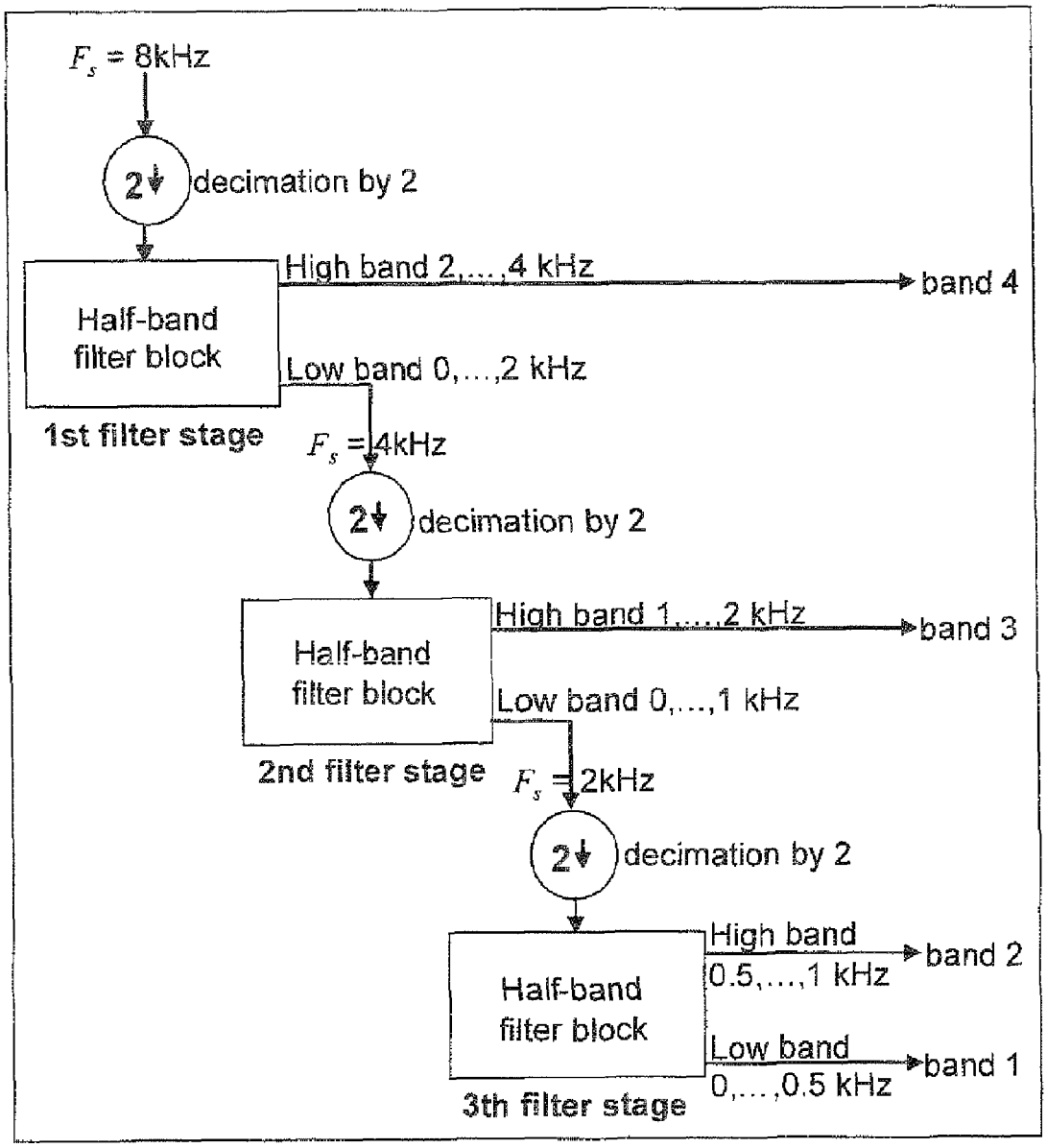
FIG. 3 illustrates an example for obtaining sub-band signals from a telephony content signal, by using half-band filter blocks.

In the embodied PCM-domain speech/non-speech discriminator the input signal of 8 kHz linear samples is first split into 4 sub-bands by a filter bank depicted in FIG. 3. The following filtering is one example of the filtering procedure according to a method of the present invention, see e.g. the filtering procedure (110) of FIG. 1, or of the filter (210) of the signal processing device according to another embodiment of the present invention. The half band filter blocks of each stage are identical and split the signal into low and high parts in the middle at $\pi/2$ which corresponds to Fs/4, where Fs stands for the sampling frequency. Each filter stage decimates the sampling frequency by 2 and consequently halves the widths of the frequency bands (given in Hz) of the subsequent stages with respect to the preceding ones. In FIG. 3 it is shown a filter bank that splits the input signal into 4 sub-bands.

High and low pass filters in a half-band filter block are realized by all pass sub-filters. This is a method known in the art and its principles are illustrated in the FIG. 4. The z-transforms of the impulse responses of the half band filters and all pass sub-filters are given below:

ti Low pass filter$=LP(z^{-1})=0.5*(z^{-1}*A1(z^{-2})+A2(z^{-2}))$

High pass filter$=HP(z^{-1})=0.5*(z^{-1}*A1(z^{-2})-A2(z^{-2}))$

All pass filter $z^{-1}*A1(z^{-2})=z^{-1}*(c1+z^{-2})/(1+c1*z^{-2})$ where c1=21955/32768

All pass filter $A2(z^{-2})=z^{-1}*(c2+z^{-2})/(1+c1*z^{-2})$, where c2=6390/32768

Note, that $z^{-2}$ in the all pass filters embeds the decimation by 2.

Figure 4:
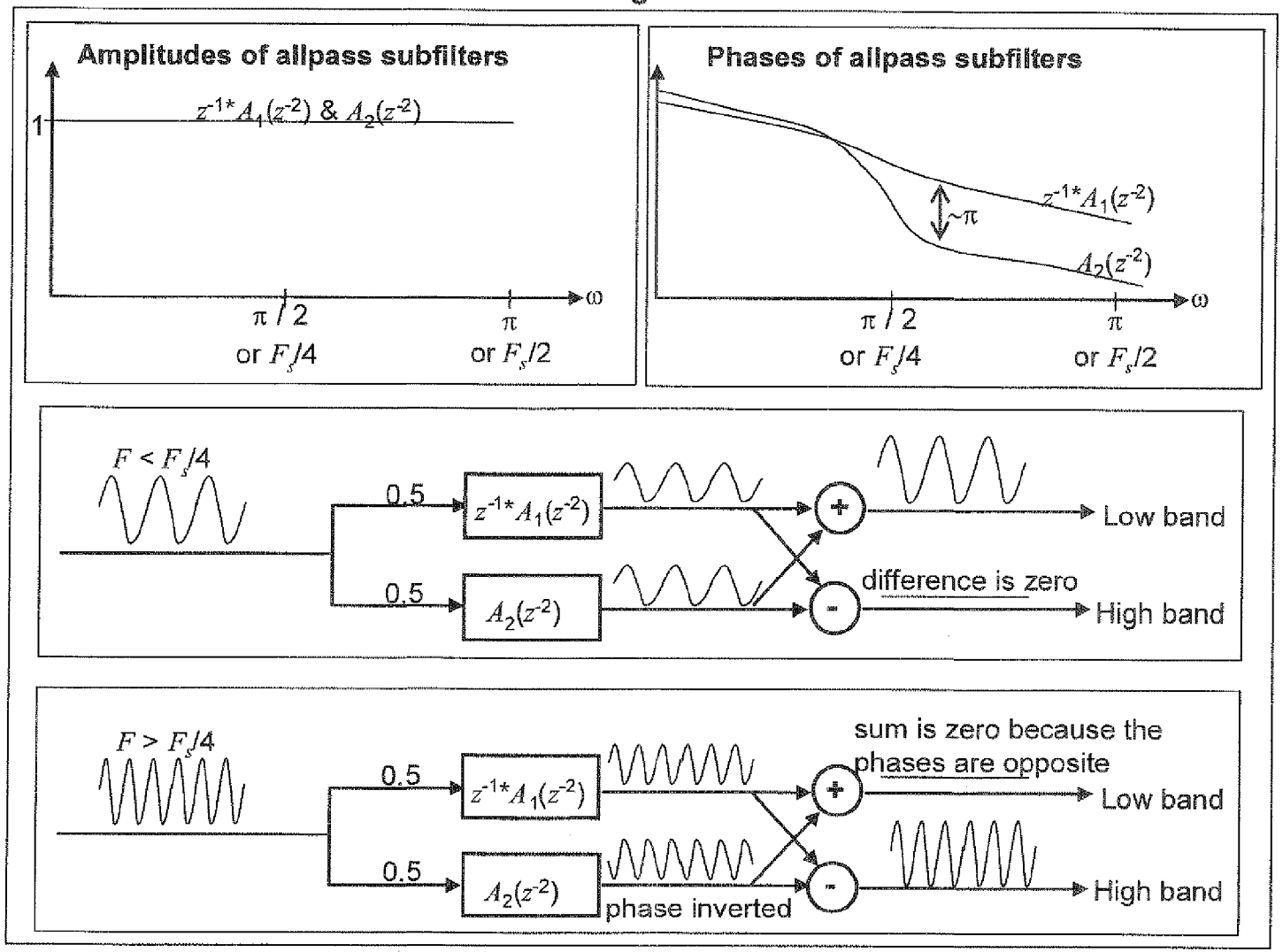
FIG. 4 is an illustrative example of half-band filters realized by all pass sub-filters.

FIG. 4 provides an illustration of half-band filters realized by all pass sub-filters. The amplitudes of such all pass filters are as close to unity as possible with all frequencies like illustrated in the upper left corner of the FIG. 4. However the phases of the all pass filters behave like in the upper right corner, which illustrates that starting from the middle of the band $\pi/2$ (or Fs/4) upwards there will be a phase difference of about 7 between the phases of the above all pass filters.

This implies that frequencies which are lower than $\pi/2$ (or Fs/4) pass through both of the all pass filters with equal phase shifts and when they are added together on the low band branch, they enforce each other, but their difference on the high band branch is zero. This is illustrated in the middle of the FIG. 4.

On the other hand frequencies that are higher than $\pi/2$ or Fs/4) pass through the all pass filters so that their phase shifts differ by $\pi$, or they have opposite phases. Consequently they cancel each other, when they are added on the low band branch but enforce each other when they are subtracted on the high band branch. This is illustrated at the bottom of the FIG. 4.

The above infinite impulse response (IIR) filters are typically realized with the help of internal state d1(i) and d2(i) respectively and with the following recursions:

$$d1(i)=x(2i-1)-c1*\mathrm{d1}(i-1)$$

$y1(i)=c1*d1(i)+d1(i-1)$, where $y1(i)$ corresponds to the output of the all pass filter $z^{-1}*A1(z^{-2})$ $$d2(i)=x(2i)-c2*d2(i-1)$$

$y2(i)=c2*d2(i)+d2(i-1)$, where $y2(i)$ corresponds to the output of the all pass filter $A2(z^{-2})$ $lp(i)=0.5*(y1(i)+y2(i))$, where $lp(i)$ corresponds to the output of the low band filter $hp(i)=0.5*(y1(i)-y2(i))$, where $hp(i)$ corresponds to the output of the high band filter.

It is noted, that because of the decimation by two the above recursions are made at every other input sample x(2i). It is also noted that x(2i−1) is used as the input sample for d1(i) since $A1(z^{-2})$ is multiplied by $z^{-1}$ (corresponding to unit delay).

Figure 5:
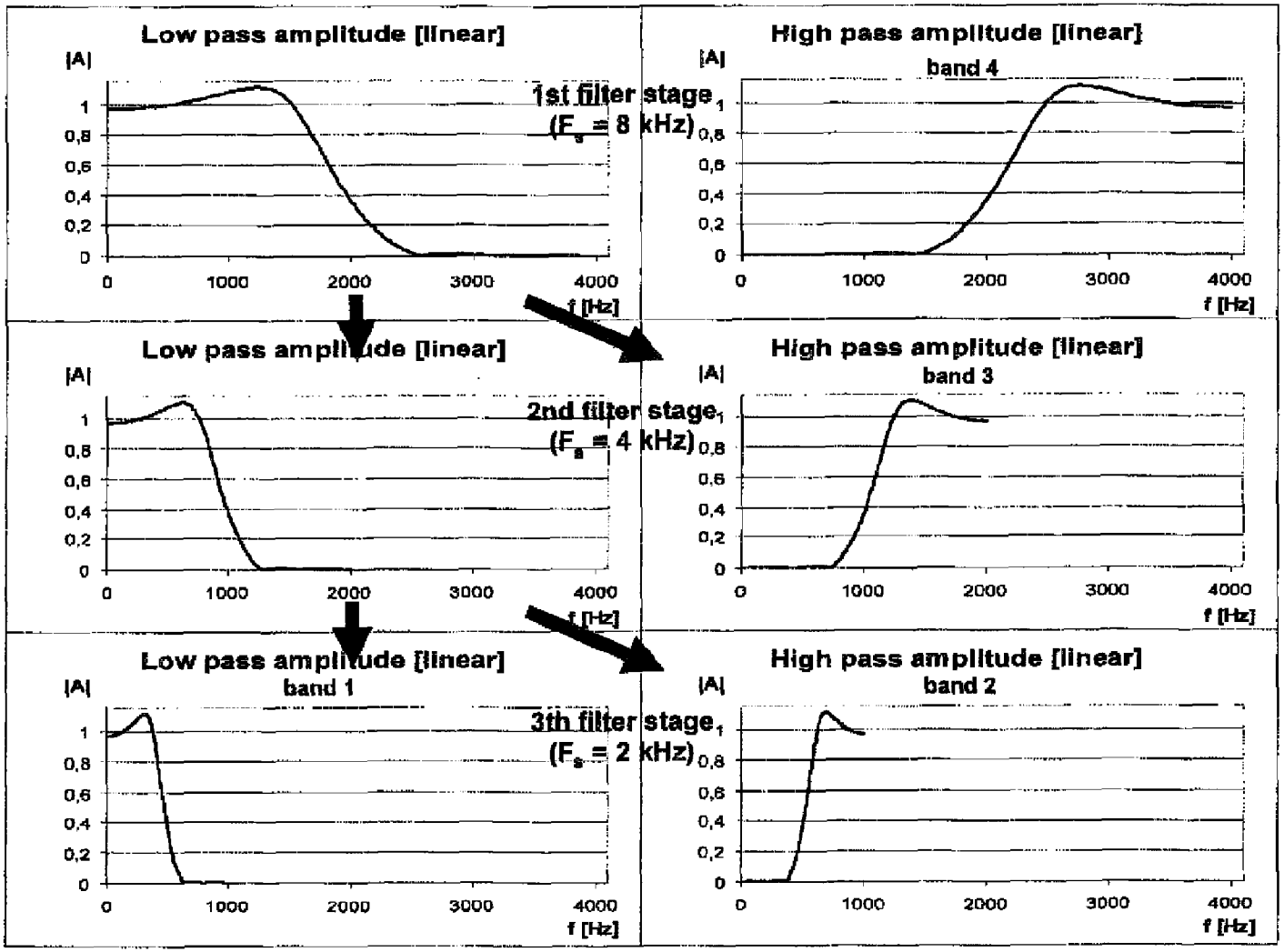
FIG. 5 shows linear amplitudes of different filter stages, according to an example of filtering an input signal like the telephony content signal.

FIG. 5 depicts the linear amplitude responses of different filter stages used in the filter bank of the embodied speech/non-speech discriminator.

The sub-band signal power may be estimated in many ways. The most typical are a sum of squares or a sum of absolute values. In some examples, the sub-band signal power may be based on the sum of the absolute values of the sub-band levels ($b_b(i)$) according to the following equation:

$$bl_n = \sum_{i=0}^{N_n-1} |b_n(i)|,$$

where n=0, . . . , 4 stands for the sub-bands and $N_n$ represents the interval size over which the levels are sampled.

As explained above, other implementations may however be possible.

The index n=0 stands for the total level of the unfiltered voice signal, n=1 stands for the band 1, which is the low band output of the filter stage 3 (i.e. 0, . . . , 0.5 kHz), n=2 stands for the high band output of the filter stage 3 (i.e. 0.5, . . . , 1 kHz), n=3 stands the high band output of the filter stage 2 (i.e. 1, . . . , 2 kHz) and n=4 stands for the high band output of the filter stage 1 (i.e. 2, . . . , 4 kHz). In the embodiment the interval size $N_n$ represents 50 ms of time so that $N_0$=400, $N_1$=$N_2$=50, $N_3$=100 and $N_4$=200 with original voice sampling frequency Fs=8 kHz. In order to normalize the level samples due to cascaded decimation by 2, $bl_1$ and $bl_2$ are multiplied by 8, $bl_3$ by 4 and $bl_4$ by 2.

The above explained techniques represent only one example for carrying out a filtering of the present invention, which is however not restricted to the above example. In fact, the skilled person would realize that also other filtering techniques available in the art are suitable for implementation in the present invention in place of the example above provided. Furthermore, it should be noted that the band signal set of the present invention does not need to comprise all the filtered signals output by the filter but can comprise only a part of said filtered signals. In the examples given above, the unfiltered signal is filtered to produce four sub-band signals. The band signal set of the present invention may therefore comprise for example only one sub-band signal (e.g. one sub-band signal among n=1, 2, 3 or 4), two or more of said sub-band signals or, in a further examples, may also comprise the unfiltered signal. Therefore, with reference to the filtering procedure of the method of the present invention, the band signal set may comprise only one or some among the unfiltered signal and the sub-band signals.

In the following, the behavior of the sub-band levels will be discussed.

Figure 6:
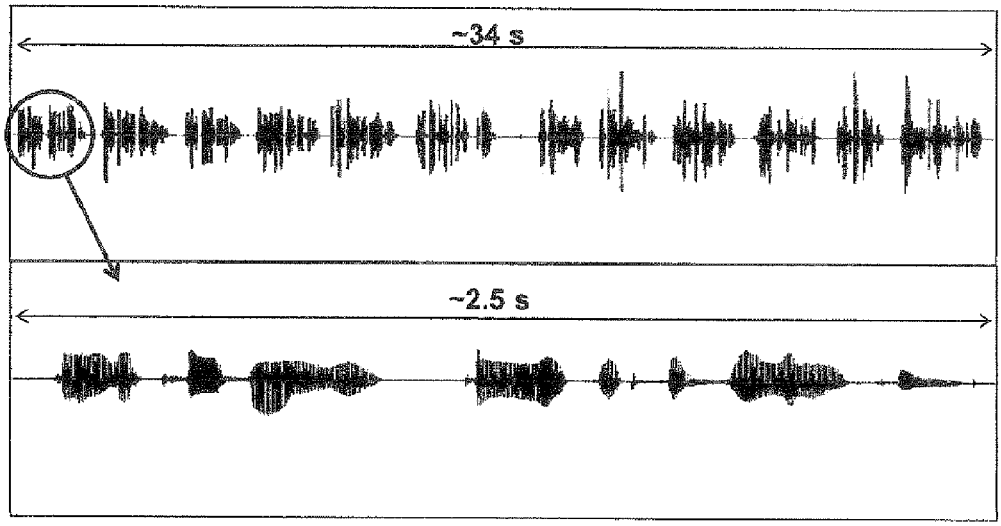
FIG. 6 shows linear samples of a typical speech recording as analyzed in one illustrative implementation of the invention.
Figure 7:
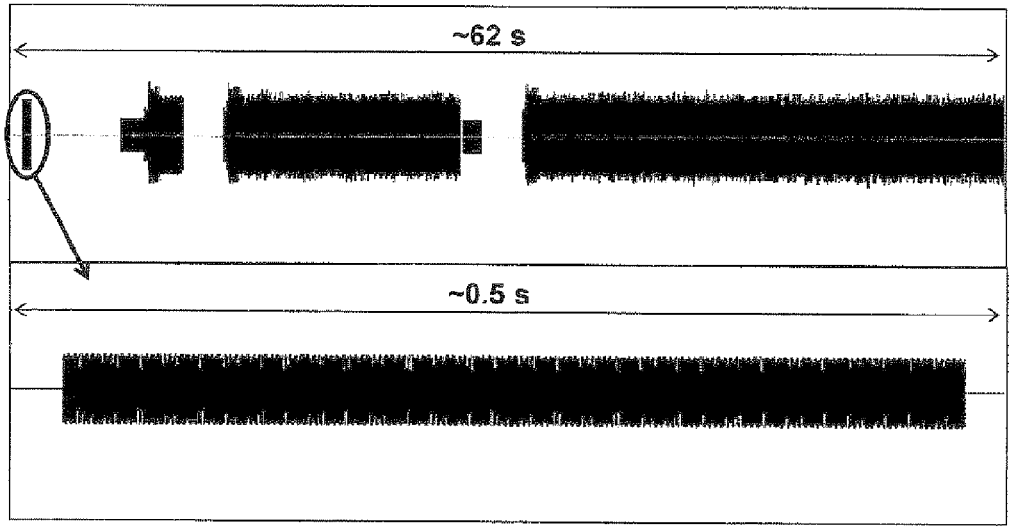
FIG. 7 shows linear samples of a typical VBD recording of a 9600 kbps fax, according to one example of non speech signal.

In order to illustrate how the sub-band levels behave with speech and different non-speech (like voice band data or VBD) signals some PCM recordings were filtered by the specified filter banks and the respective levels were estimated by a functional C-model. A couple of typical PCM recordings are plotted in the FIGS. 6 and 7. More specifically, FIG. 6 shows linear samples of a typical speech recording and FIG. 7 shows linear samples of a typical VBD recording (9600 kbps fax in the example).

Figure 8:
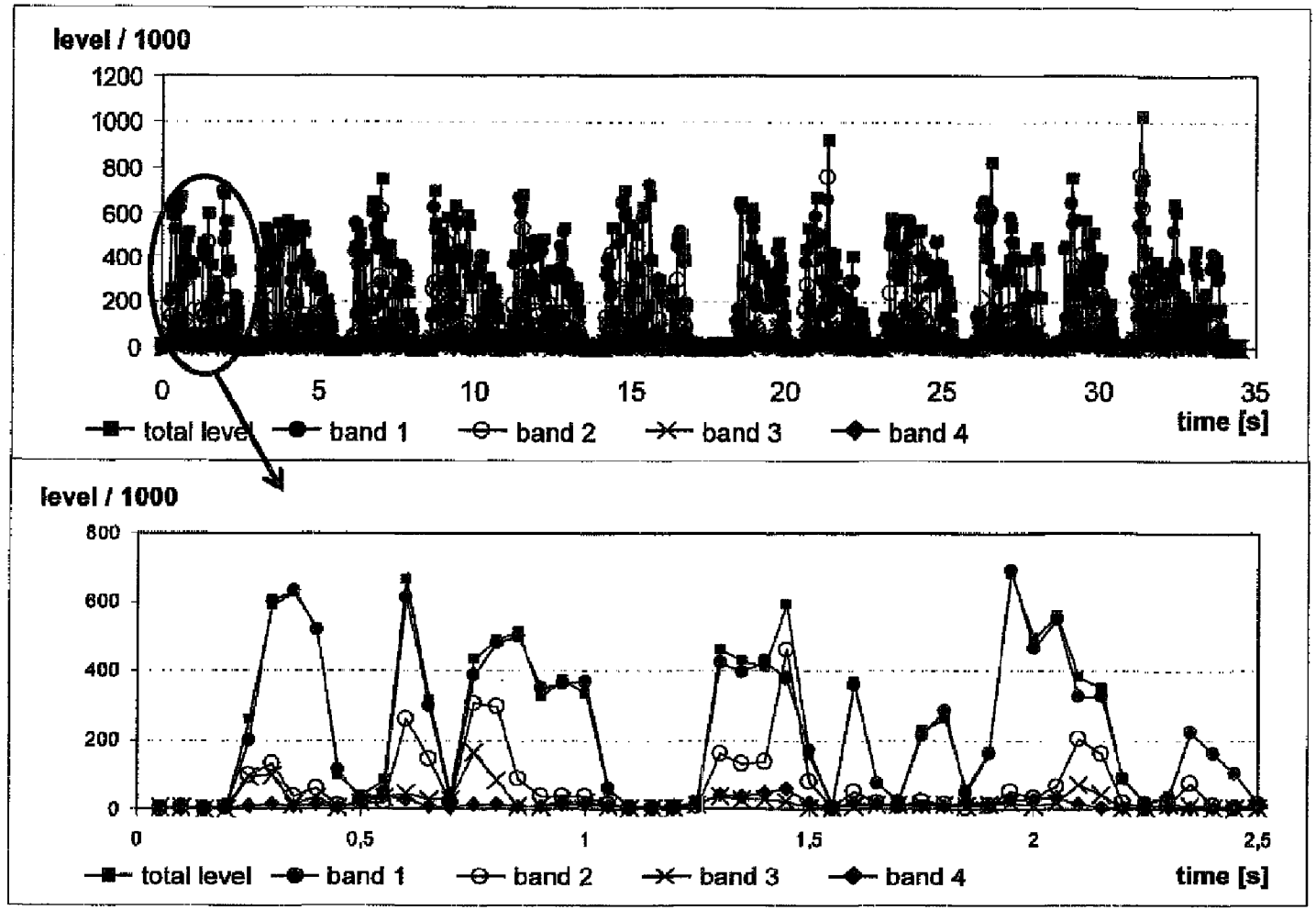
FIG. 8 shows sub-band level samples of the speech recording according to an example of speech signal to which the invention can be applied; in the illustrated case, an illustrative time interval of 50 ms is represented.
Figure 9:
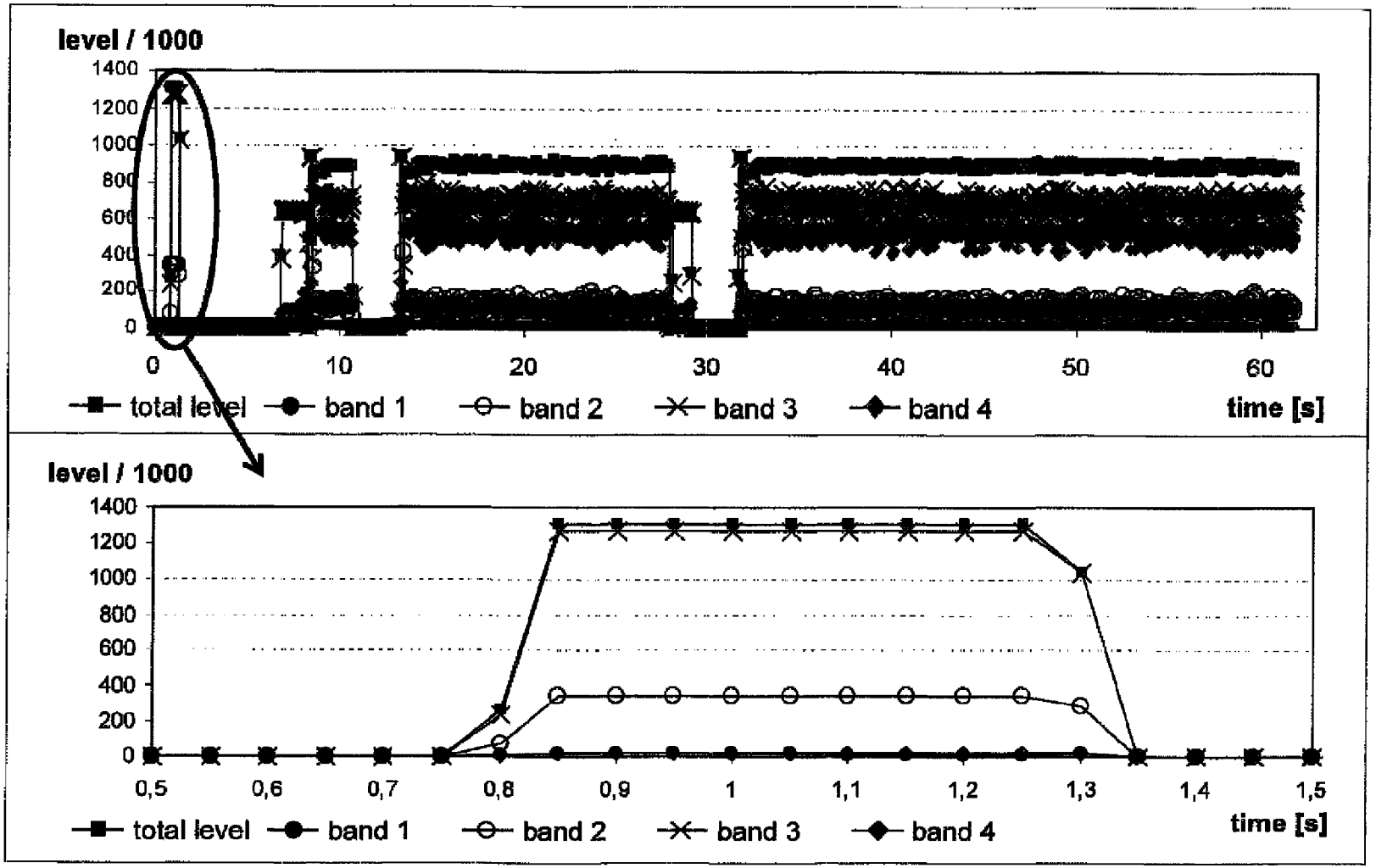
FIG. 9 shows sub-band level samples of the VBD recording according to an example of non speech signal to which the invention can be applied; in the illustrated case, an illustrative time interval of 50 ms is represented.

The sub-band level samples per 50 ms intervals are plotted for the same examples in FIGS. 8 and 9. Similar plots could be obtained also for a different choice of the interval, e.g. 20 ms.

Next, the speech/non speech decision will be discussed with reference to the embodiment under consideration.

Some observations can be made by the sub-band level curves in FIGS. 8 and 9 referred above:

- For non-speech (like VBD tones) the sub-band levels are clearly separated from each other whereas for speech they are mixed on top of each others;
- Sub-band levels of VBD tones have smaller variance than levels of speech;
- Some of the sub-band levels of VBD tones are close to zero also during active periods, especially when the modulation is small (like single or dual frequencies).

The same observation can be easily verified for other types of signals and coding as also described above. In fact, the same behavior would result when taking different types of non speech, like modem signals, CTM signals, . . . , or for other types of coding for the speech (like Differential PCM, . . . ).

A decision algorithm was developed based on these observations. A decision is made at the beginning of each silence period, if the previous active period was long enough to get reliable sub-band level estimates (in the embodiment the limit was set to 0.5 s). Thus the decision algorithm is executed at most ~2 times per second. The silence period may be detected by a suitable PCM-domain silence detector of known type. However, it is important to note that the decision must not necessarily be linked to a silence detection. In fact, the decision may be linked to a predetermined timing or to another event, as also explained later in the description.

The main aspects of the decision algorithm are given below:

1. The decision is based on the estimated line lengths of the band level curves.
   - For speech the cumulative line lengths of the band level curves during active parts is clearly longer than for tones, because the variance of speech levels is bigger;
   - Line length is easy to estimate by summing up the absolute values of the deltas between two consecutive level samples (20 samples per second),
   - This represents only the y-component of the line length, but x-component is irrelevant because delta-x is always 50 ms.
2. An average line length sample (LLn') and an average total band level sample (TLn') per 50 ms may be estimated for each band n=0, . . . , 4 at the beginning of a silence period $$LL'_n = \sum_{k=0}^{N_s} |bl_n(k) - bl_n(k-1)| / N_s$$

$$TL'_n = \sum_{k=0}^{N_s} |bl_n(k)| / N_s$$

$b_1n(k)$=k:th level sample of sub-band n during the last active period (like talk spurt) and Ns=number of 50 ms periods during the last active period, and n=1, . . . , 4 stand for the sub-band and n=0 stands for the total signal level Estimates are made at the beginning of each silence period, which is detected by the PCM-domain silence detector.

3. Because the false detection of VBD as speech is considered more serious than the other way around, its probability is made smaller and recovery faster, if LLn' and Tln' are further filtered with the following asymmetric low pass (ALP) filters:

$$\text{if } (LL_n' < LL_n(s-1))\, LL_n(s) = LL_n'$$

$$\text{else } LL_n(s) = (1-\alpha_1)*LL_n(s-1) + \alpha_1 * LL_n'$$

$$\text{if } (TL_n' > TL_n(s-1))\, TL_n(s) = TL_n'$$

$$\text{else } TL_n(s) = (1-\alpha_2)*TL_n(s-1) + \alpha_2 * TL_n'$$

where n=band index 0, . . . , 4, s=current decision point, s−1=previous decision point, $\alpha_1$ and $\alpha_2$ are experimental coefficients (in one embodiment $\alpha 1=\alpha 2=0.25$ may be selected; but different combinations of the two values are possible);

4. The final speech/non-speech decision (boolean spMode) may be based on the ratios between $TL_n(s)$ and LLn(s) according to the following algorithm:

```
if (TLn(s) > HIGH_LIMIT * LLn(s) for any n ∈ [0,...,4]) spMode =
FALSE
else if (TLn(s) < LOW_LIMIT * LLn(s) for at least 4 of the n ∈ [0,...,4])
    spMode = TRUE
else keep spMode = spMode
```

where HIGH_LIMIT and LOW_LIMIT are experimental tuning parameters. HIGH_LIMIT=20 and LOW_LIMIT=10 were used in this embodiment.

5. For tones some of the sub-band levels may typically be low also during active periods. It is taken into account by setting a lower bound for the sub-band levels so that $TL_n(s) >= TL_0(s)/MARGIN$ for n=1, . . . , 4 (in one embodiment MARGIN=64 may be selected corresponding to ~−36 dB). This method increases $TL_n(s)/LLn(s)$ ratios for extremely low sub-band levels and thus increases the probability of deciding the period as non-speech, which is most likely correct.

In the above listing of the decision algorithm, it can be seen that points 1. to 5. may be specific implementations of the determination procedure and/or of the discrimination procedure according to the method of the present invention. The same can be implemented by a computer program or by the signal processing device of the invention. Moreover, the mentioned points can also be implemented separately or in combination according to the general method, computer program or signal processing device of the present invention. Further, the above implementations are not limiting for the invention since variation of said specific implementations are possible as the skilled person would readily recognize.

In the following, the performance of the speech/non-speech decision algorithm will be discussed for the embodiment of the invention under consideration referring to the PCM domain. The same advantages would however follow also from the other embodiments of the present invention.

FIGS. 10 and 11 illustrate the ratios of TLn(s)/LLn(s) at the decision points (s) in the beginning of detected silence periods. The decision points are marked by triangles on top of x-axis. FIG. 10 shows the TLn(s)/LLn(s) ratios for the speech recording of the FIG. 6 and FIG. 11 shows the TLn(s)/LLn(s) ratios for the VED recording of the FIG. 7.

FIG. 10 shows that spMode would be set TRUE at all decision points because all the ratios are every time below LOW_LIMIT, whereas in FIG. 11 spMode would be set FALSE because the ratios are almost every time above HIGH_LIMIT. Thus, correct decisions are made at each decision point in both cases. The algorithm was verified by many examples and with the embodied parameter settings the decision was always made correctly.

In the following, the complexity of the PCM-domain speech/non speech discriminator will be discussed. Similar considerations apply to other embodiments of the invention, as the skilled reader would readily recognize.

An estimation will now be provided of the amount of elementary operations per second (ops/s) that the embodiment of the PCM-domain speech/non-speech discriminator requires.

The processing capacity required by the conversion from A-/μ-law compressed domain to linear domain is excluded, because it is assumed to be included already in the PCM-domain silence detector, which would be required in any case also with standardized tone detectors and is most likely excluded from their processing capacity estimates too—and any case it is very insignificant. It is noted that in other embodiment the silence detector may be omitted, thus making the following estimation even more accurate.

Number of operations per filter stage and per sample:
4 multiplications
6 additions
Execution rate of different filter stages:
Stage 1: 4000/s
Stage 2: 2000/s
Stage 3: 1000/s
Estimates of elementary operations per second:
Total signal level measurement: 8000*1 add/s+8000*1 abs/s
Stage1 including level: 4000*4 mul/s+4000*7 add/s+4000*1 abs/s
Stage2 including level: 2000*4 mul/s+2000*7 add/s+2000*1 abs/s
Stage4 including 2 levels: 1000*4 mul/s+1000*8 add/s+1000*2 abs/s
Accumulation of LLn' and TLn' samples (once per 50 ms): 20*21 add/s+20*10 abs/s
decision at the beginning of each silence period (max rate=once per 0.5 s): 2*13 mul/s+2*15 add/s+2*10 div/s=26 mul/s+30 add/s+20*16*(shift+and+add)/s
Sub-totals per elementary operation:
28026 mul/s
58910 add/s (shift+and+add needed by div is replaced by 2 adds in this sub-total estimate)
16200 abs/s.

Grand total=103136 ops/s (max)=~0.1 MOPS<=~0.1 MIPS. Converting the elementary operations per second to MIPS depends on the architecture of the processing unit and how the implementation is optimized, but typically the MIPS-number is smaller than the respective MOPS-number, because elementary operations can usually be pipelined and thus executed effectively in parallel, which saves clock cycles.

Compared to state of the art tone detector algorithms, that require usually ~1 MIPS, the savings in the processing capacity per silence detector is ~90% yielding of the order of 10 times more device instances per processing unit, when services of the device are otherwise simple like for instance just jitter buffering and frame handling, which is a typical PCM-domain transit use case in a network node like a mobile media gateway (M-MGW).

Similar advantages can be easily verified for other embodiments of the invention.

In summary, the present invention provides a series of advantages as illustrated above and in the following. In fact, the present invention saves processing capacity in certain cases by replacing more complicated state of the art tone detector with a PCM-domain speech/non-speech discriminator, that may even be more generic and covering more call cases than the standard or traditional tone detectors in certain use cases like for instance preventing adaptive jitter buffering in transit VBD call cases, when traffic type is 64 kbps PCM and control plane is not able to tell whether the content is speech or VBD, but still the adaptive jitter service is reserved because of speech quality reasons. In this case using adaptive jitter buffering would disturb or even prevent VBD calls completely, but using the PCM-domain speech/non-speech discriminator described in this invention disclosure solves the problem.

The channel density can even be increased by the order of ten times in certain use cases (like the above) compared to state of the art tone detectors thus causing the respective production cost savings.

Other advantages consist in that thanks to the discrimination performed on at least on sub-band signal of the telephony content signal, a more accurate discrimination can be achieved. A further advantage consists in that the higher accuracy is achieved while keeping the processing requirements (i.e. the consumption of processing power) at very low levels. Further advantages will be apparent to the skilled person when implementing the various embodiments and variation thereof.

It is noted that FIG. 9 provides only one example. However, several other VBD signals and speech samples can be used in place of those mentioned in the examples, as the inventors verified and as the skilled person would also be able to easily verify. For instance, with reference to VBD data not only facsimile data can be considered but also CTM signals (e.g. 3GPP 26.226).

It is noted that the invention has further advantages in those cases where the decision must be reversible and the detector has to run all the time. In these situations, the present invention requires much less processing capacity and is thus much "lighter" than other known implementations.

An advantage of the invention lies in that the decision and the discrimination can be based on easy to calculate parameters. Other known techniques, instead, rely on heavy calculation or take into consideration also other parameters, like for instance noise, which add to the complexity of the prior art algorithms. The present invention overcomes the limitation and disadvantages of the prior art.

Furthermore, it has been mentioned that the decision may be made after detection of a silence period. This is for instance the case when the decision is needed for controlling the adaptive jitter buffer. However, the present invention is not limited to the detection of silence and it may also be applied using for instance a deadline or timeout for making the decision or by implementing any other kind of condition for performing the decision or for triggering the decision to be performed.

It is also important to note that the present invention provides a good immunity to noise, i.e. it provides high performance also over different types of noise (electrical noise, acoustical noise, background acoustical noise, stationary noise during silence period in speech, etc. . . . ) as it can be easily verified.

Mention was made of an interval of 50 ms, which was chosen according to some tests and measurements performed. However, the present invention works and provides still high performance with other intervals, like and not limited to intervals of 10 ms, 20 ms, . . . , 100 ms just to name an example. In other words, the present invention is not limited to any particular choice of the interval.

The present invention is suitable for being implemented in a network node of a communication network, like for instance a media gateway. Thus, a network node like a media gateway may be arranged in order to perform the method or parts of the method of the present invention for discriminating a telephony content signal. Further, a network node like a media gateway may comprise a signal processing device for discriminating a telephony content signal as described in the present invention. In one example, a media gateway may comprise a signal processing device as depicted in FIG. 2. Furthermore, a media gateway may comprise a compute program product arranged for performing the method or parts of the method according to the present invention. In the case of a media gateway, the invention provides the mentioned advantages for instance in those cases wherein the media gateway is performing for instance jitter buffering and/or frame handling, which is a typical PCM-domain transit use case in a network node like a mobile media gateway (M-MGW).

It will be apparent to those skilled in the art that various modifications and variations can be made in the entities and methods of the invention as well as in the construction of this invention without departing from the scope or spirit of the invention.

The invention has been described in relation to particular embodiments and examples which are intended in all aspects to be illustrative rather than restrictive. Those skilled in the art will appreciate that many different combinations of hardware, software and firmware will be suitable for practicing the present invention.

Moreover, other implementations of the invention will be apparent to those skilled in the art from consideration of the specification and practice of the invention disclosed herein. It is intended that the specification and the examples be considered as exemplary only. To this end, it is to be understood that inventive aspects lie in less than all features of a single foregoing disclosed implementation or configuration. Thus, the true scope and spirit of the invention is indicated by the following claims.

The invention claimed is:

1. A method for discriminating a telephony content signal into a first category or a second category, the method comprising:

obtaining from the telephony content signal a band signal set comprising one or more band signals, each band signal being associated with a respective frequency band, one or more of said band signals each comprising a sub-band signal associated with a sub-band of an overall frequency band of the telephony content signal;

determining a band signal variation value and a band signal strength value for each band signal of said band signal set; and discriminating whether the telephony content signal is of the first category or of the second category, by either unconditionally or conditionally evaluating a relationship of said band signal variation value and said band signal strength value for the one or more sub-band signals.

2. The method of claim 1, wherein said band signal set includes the unfiltered telephony content signal.

3. The method of claim 2, wherein said discriminating comprises unconditionally evaluating a relationship of said band signal variation value and said band signal strength value for said unfiltered telephony content signal, and conditionally evaluating a relationship of said band signal variation value and said band signal strength value for said one or more sub-band signals, depending on whether said unconditional evaluation results in a discrimination decision.

4. The method of claim 1, wherein the first category is speech and the second category is non-speech.

5. The method of claim 4, wherein a non-speech state is discriminated if for at least one of said one or more sub-band signals a ratio of the band signal strength and the band signal variation value exceeds a predetermined first threshold.

6. The method of claim 4, wherein a speech state is discriminated if for k of said one or more sub-band signals a ratio of the band signal strength and the band signal variation value falls below a predetermined second threshold, wherein said set comprises N band signals, wherein k and N are integers, and wherein $k \leqq N$.

7. The method of claim 4, wherein said discriminating comprises a speech state detection part and a non-speech state detection part, wherein said discriminating is performed for successive decision points, and wherein if neither said speech state detection part nor said non-speech state detection part result in a discrimination result for a particular decision point, said discriminating comprises retaining a discrimination state from a previous decision point.

8. The method of claim 1, wherein said telephony content signal is a Pulse Code Modulation (PCM) voiceband signal.

9. The method of claim 1, wherein said determining comprises determining band samples for each band signal of said band signal set, and determining said band signal variation value comprises summing differences of said band samples over a predetermined range.

10. The method of claim 9, wherein said differences are differences of consecutive band samples.

11. The method of claim 9, wherein said determining of said band variation value comprises summing absolute values of said differences.

12. The method of claim 9, wherein said band samples are determined by summing absolute values of band signal levels over a predetermined time period.

13. The method of claim 1, wherein said determining is performed for successive decision points, wherein for each decision point a preliminary band signal variation value and a preliminary band signal strength value is determined for each band signal of said band signal set, and wherein said determining comprises a modification procedure for determining, for each band, at least one of:

said band signal variation value for a given decision point in dependence on said preliminary band signal variation value and a band signal variation value associated with a previous decision point, and said band signal strength value in dependence on said preliminary band signal strength value and a band signal strength value associated with a previous decision point.

14. The method of claim 13, wherein said modification procedure is asymmetric for damping at least one of increases in said band signal variation value and decreases in said band signal strength value.

15. The method of claim 14, wherein said modification procedure is configured to set at least one of:

said band signal variation value (LLn) for said given decision point (s) such that $$LL_n(s)=(1-\alpha_1)\times LL_n(s-1)+\alpha_1\times LL_n', \text{ if } LLn'>LLn(s-1),$$

where LLn(s) represents the band signal variation value for the given decision point, LLn(s−1) represents the band signal variation value for the previous decision point, $\alpha_1$ represents a constant with $0 \leqq \alpha 1 \leqq 1$, and LLn' represents the preliminary band signal variation value, and said band signal strength value (TLn) for said given decision point (s) such that $$TL_n(s)=(1-\alpha_2)\times TL_n(s-1)+\alpha_2\times TL_n', \text{ if } TLn'<TLn(s-1),$$

where TLn(s) represents the band signal strength value for the given decision point, TLn(s−1) represents the band signal strength value for the previous decision point, α2 represents a constant with $0 \leqq \alpha 2 \leqq 1$, and TLn' represents the preliminary band signal strength value.

16. A computer program product stored on a non-transitory computer readable medium and comprising program parts that, when executed on a programmable processor associated with a signal processing device, cause the signal processing device to discriminate a telephony content signal into a first category or a second category, the program parts causing the signal processing device to:

obtain from the telephony content signal a band signal set comprising one or more band signals, each band signal being associated with a respective frequency band, one or more of said band signals each comprising a sub-band signal associated with a sub-band of an overall frequency band of the telephony content signal;

determine a band signal variation value and a band signal strength value for each band signal of said band signal set; and discriminate whether the telephony content signal is of the first category or of the second category, by either unconditionally or conditionally evaluating a relationship of said band signal variation value and said band signal strength value for the one or more sub-band signals.

17. A signal processing device for discriminating a telephony content signal into a first category or a second category, comprising:

a filter configured to obtain from the telephony content signal a band signal set comprising one or more band signals, each band signal being associated with a respective frequency band, one or more of said band signals each comprising a sub-band signal associated with a sub-band of an overall frequency band of the telephony content signal;

a determinator configured to determine a band signal variation value and a band signal strength value for each band signal of said band signal set; and a discriminator configured to discriminate whether the telephony content signal is of the first category or of the second category, by evaluating a relationship of said band signal variation value and said band signal strength value for each band signal of said band signal set.

18. The signal processing device of claim 17, wherein the signal processing device is comprised in a node of a communication network.

19. The signal processing device of claim 18, wherein the node of a communication network is a media gateway.

* * * * *

UNITED STATES PATENT AND TRADEMARK OFFICE

CERTIFICATE OF CORRECTION

PATENT NO. : 8,407,044 B2
APPLICATION NO. : 13/126894
DATED : March 26, 2013
INVENTOR(S) : Mahkonen It is certified that error appears in the above-identified patent and that said Letters Patent is hereby corrected as shown below:

In the Specification:

In Column 1, Line 54, delete "or" and insert -- (or --, therefor.

In Column 4, Line 22, delete "point;" and insert -- point; and --, therefor.

In Column 15, Line 15, delete "Namley," and insert -- Mainly, --, therefor.

In Column 16, Line 30, delete " $z^{-1*}(c2+z^{-2})/(1+c1*z^{-2})$, " and insert -- $(c2+z^{-2})/(1+c1*z^{-2})$, --, therefor.

In Column 16, Line 41, delete "7" and insert -- $\pi$ --, therefor.

In Column 17, Line 18, delete "($b_b$(i))" and insert -- ($b_n$(i)) --, therefor.

In Column 19, Line 21, delete "possible);" and insert -- possible). --, therefor.

In Column 19, Line 67, delete "VED" and insert -- VBD --, therefor.

In Column 22, Line 15, delete "compute" and insert -- computer --, therefor.

Signed and Sealed this
Seventeenth Day of September, 2013

Teresa Stanek Rea
*Deputy Director of the United States Patent and Trademark Office*